US007441557B2

(12) United States Patent
Judson

(10) Patent No.: US 7,441,557 B2
(45) Date of Patent: Oct. 28, 2008

(54) BARREL FOR PAINT-BALL GUN

(75) Inventor: Robert Judson, Dallas, TX (US)

(73) Assignee: SJS Paintball, LP, Richardson, TX (US)

( * ) Notice: Subject to any disclaimer, the term of this patent is extended or adjusted under 35 U.S.C. 154(b) by 274 days.

(21) Appl. No.: 11/281,636

(22) Filed: Nov. 17, 2005

(65) Prior Publication Data

US 2006/0065260 A1 Mar. 30, 2006

Related U.S. Application Data

(62) Division of application No. 10/840,147, filed on May 6, 2004.

(51) Int. Cl.
*F41B 11/00* (2006.01)

(52) U.S. Cl. ..... 124/83; 124/73

(58) Field of Classification Search ..... 124/73, 124/74, 83; 138/39, 44, 109, 177, 178; 141/331; 42/78

See application file for complete search history.

(56) References Cited

U.S. PATENT DOCUMENTS 330,873 A * 11/1885 Cobb ..... 285/55
513,318 A * 1/1894 Grimm ..... 242/118.61
731,194 A * 6/1903 Lovekin ..... 110/323
1,029,720 A * 6/1912 Schellenger ..... 89/176
1,238,672 A * 8/1917 Hopwood ..... 239/72
1,298,532 A * 3/1919 Mapelsden ..... 73/861.61
1,659,625 A * 2/1928 Cowan ..... 42/78
2,791,148 A * 5/1957 Maisch ..... 86/31
5,228,427 A * 7/1993 Gardner, Jr. ..... 124/71
5,572,982 A * 11/1996 Williams ..... 124/74
5,639,981 A * 6/1997 French ..... 89/1.3
5,640,945 A * 6/1997 Slonaker et al. ..... 124/56
5,664,359 A * 9/1997 Sabranski et al. ..... 42/78
5,823,173 A * 10/1998 Slonaker et al. ..... 124/56
6,213,112 B1 * 4/2001 Squire ..... 124/74
6,273,080 B1 * 8/2001 Sullivan, Jr. ..... 124/84
6,347,622 B1 * 2/2002 Hsueh ..... 124/49

* cited by examiner

*Primary Examiner*—John Ricci
(74) *Attorney, Agent, or Firm*—John A. Thomas

(57) ABSTRACT

In a barrel for a paint-ball gun, the entrance to the bore has a chamfer. The chamfer has a smooth transition from the entrance to the bore; preferably in the form of a section of a circle or parabola. In another embodiment, the bore of the barrel has a similar smooth transition in the muzzle of the barrel at the exit of the bore.

2 Claims, 2 Drawing Sheets

BARREL FOR PAINT-BALL GUN

CLAIM FOR PRIORITY

This divisional application claims the priority of U.S. patent application Ser. No. 10/840,147, filed May 6, 2004, and titled "Barrel and ball sizer for paint-ball gun."

FIELD OF INVENTION

The present invention relates to guns that propel projectiles using compressed gas as a propellant. More particularly, it relates to an improved gun barrel for use in combination with a gas powered projectile gun firing soft or pliable ammunition such as paint balls.

BACKGROUND

Paint-ball guns fire a plastic-walled, paint- or gelatin-filled projectile using compressed gas as the source of power to accelerate the paint ball down a chamber and into a gun barrel. The paint ball enters the barrel from a hopper at the breech end, is accelerated by compressed gas, and exits the muzzle of the barrel.

Prior art in the area of air-powered guns, and especially paint-ball guns, uses canisters of liquid $CO_2$ or other compressed gas communicated through regulators to provide a regulated gas pressure to the gun.

Since paint balls may thus have different diameters due to manufacturing tolerances and expansion because of heat or humidity, paint-ball guns typically use a "ball sizer" attachment between the breech of the gun and the barrel. The paint ball enters the ball sizer first and is accelerated there by gas pressure to essentially its maximum velocity before entering the barrel of the gun. The user chooses a ball sizer of the appropriate diameter to match as nearly as possible the size of the paint balls he is using at that time. Ball sizers typically connect with a barrel and with the breech of the gun with threaded joints.

It is important that the transition of the ball from the ball sizer to the barrel take place smoothly, so the ball is not torn or set spinning arbitrarily when it enters the breach of the barrel.

DRAWINGS

DETAILED DESCRIPTION

Figure 1:
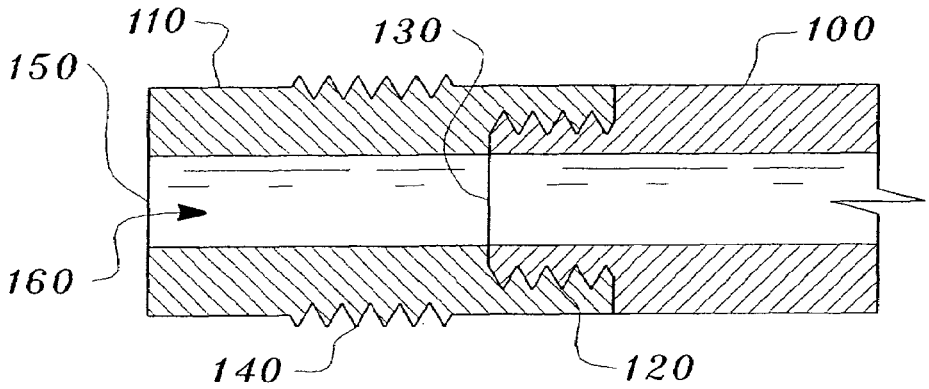
PRIOR ART Fig. 1
FIG. 1 is cut-away side view of a prior-art paint ball ball sizer and barrel.

FIG. 1 shows a cut-away view of a typical prior-art paint-ball gun barrel (100) connected to a ball sizer (110). In this and other figures, the wall thickness of the barrel and sizer is exagerated for clarity. The prior-art ball sizer (110) has a bore (150) defined by an entrance (150). Typically, the face of the entrance (150) is flush, as shown, creating a sharp boundary that a paint ball must cross as it is propelled by gas pressure into the sizer (110). This sharp boundary at the entrance (150) may catch the seam of the ball, causing erratic spin, and possibly, rupture of the ball. FIG. 1 also shows threads (140) on the sizer (110), where the sizer screws into the breech of a paint-ball gun. The barrel (110) also has threads (120) to allow it to be screwed into the sizer (110). It is difficult to make the resulting joint (130) between the barrel (100) and the ball sizer (110) exactly even, and this uneven joint (130) can also catch the seam or skin of the ball and impart erratic spin, or cause a rupture.

Figure 2:
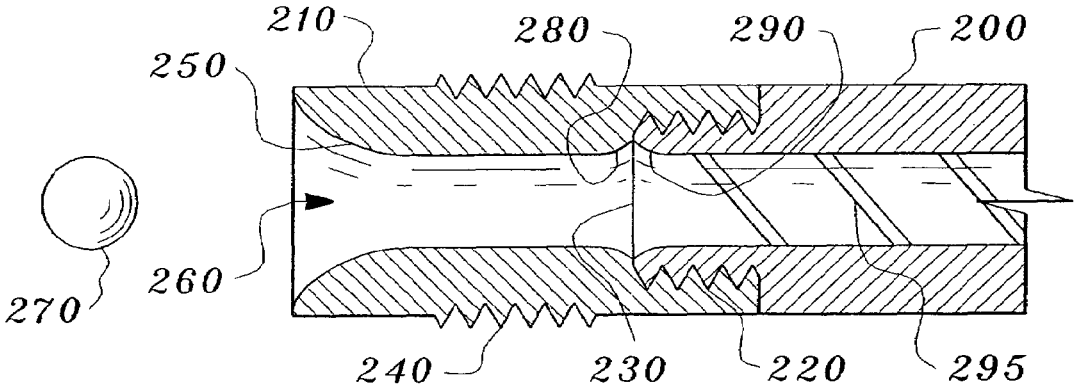
FIG. 2 is a cut-away side view of the preferred embodiment of the ball sizer and barrel.

FIG. 2 is a cut-away view of the preferred embodiment. The barrel (200) is again screwed into the ball sizer (210). A paint ball (270) is positioned to enter the bore (260) of the sizer (210). In the preferred embodiment, the entrance to the sizer (210) has a chamfer (250) with smooth transitions. This chamfer (250) is preferably an arc of a parabola, to smoothly guide the ball (270) into the bore (260). Other curves could be used for the chamfer (250), however, such as a section of a circle. The sizer (210) has outer threads (240) to allow it to be screwed into the breech of a paint-ball gun. The exit of the sizer (210) is joined to a barrel (200) by threads (220). In the preferred embodiment, the joint (230) formed at the juncture of the barrel (200) and the sizer (210) is also defined by a chamfer (280) in the sizer (210) and in the barrel (290).

Again, these chamfers (280, 290) may be described by the arc of a parabola, or other curves. In this way, the ball (270) may transition smoothly from the breech to the sizer (210), and from the sizer (210) into the barrel (200). The barrel (200) may have rifilings (295) to impart a stabilizing rotation to the ball (270).

Figure 3:
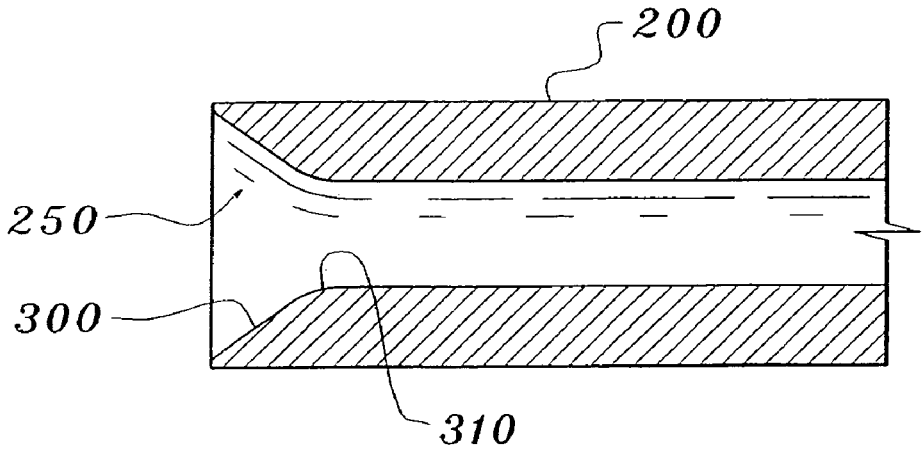
FIG. 3 is a cut-away side view of another embodiment of the ball sizer and barrel.

FIG. 3 shows a cut-away view of another embodiment. Here, the chamfer (250) in the entrance to the sizer (210) is defined by a straight-line part (300) and a curved part (310). Again, the curved part (310) may be any of the curves just discussed. A similar straight-line and curved combination chamfer may be used for the chamfers (280, 290) at the exit of the sizer (210) and the entrance of the barrel (200). The straight-line part (300) may precede the curved part (310) in this combination.

Figure 4:
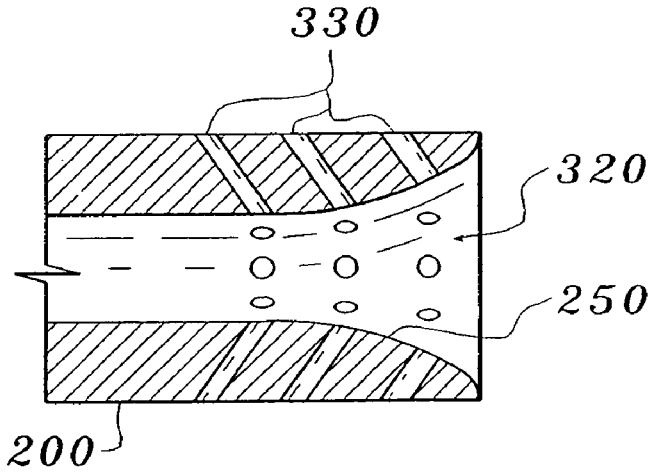
FIG. 4 is a cut-away side view of another embodiment, showing the muzzle area of the barrel.

FIG. 4 shows a cut-away view of another embodiment. Here the chamfer (250) is placed in the muzzle (320) of the barrel (200). The chamfer (250) may have a curve among those previously described, including the combination straight-line and curved parts. The figure also shows reverse ports (330) in the muzzle. Such ports are advantageous to release pressure in the barrel behind the moving paint ball in a controlled way, and also to lower the sound pressure released down range of the gun. The chamfer (250) in the muzzle (320) functions with the reverse porting to reduce the pressure in front of the ball, while centering the ball on an effective air bearing. This introduces the ball into the atmosphere with reduced shock and turbulence and improves accuracy Since those skilled in the art can modify the specific embodiments described above, I intend that the claims be interpreted to cover such modifications and equivalents.

I claim:

1. A barrel for a paint-ball gun, comprising:

a muzzle;

the muzzle having reverse ports;

a bore, the bore having an exit at the muzzle;

the muzzle having a chamfer; and, the chamfer having a smooth transition from the bore of the barrel to the exit at the muzzle.

2. The barrel of claim 1, where the barrel has rifling.

* * * * *